United States Patent [19]

Saigo et al.

[11] Patent Number: 4,571,208

[45] Date of Patent: Feb. 18, 1986

[54] TOY WITH SWING

[75] Inventors: Hiroshi Saigo, Kasukabe; Kazuo Nagamori, Tokyo, both of Japan

[73] Assignee: Iwaya Corporation, Tokyo, Japan

[21] Appl. No.: 581,881

[22] Filed: Feb. 21, 1984

[30] Foreign Application Priority Data

Aug. 25, 1983 [JP] Japan ..... 58-155546

[51] Int. Cl.[4] ..... A63H 11/00

[52] U.S. Cl. ..... 446/353; 446/301; 446/322

[58] Field of Search ..... 446/322, 323, 330, 331, 446/352, 353, 354, 361, 362, 368, 313, 297, 298, 300, 301; 74/435

[56] References Cited

U.S. PATENT DOCUMENTS

| | | | |
|---|---|---|---|
| 1,049,345 | 1/1913 | Dolman | 46/353 |
| 2,158,860 | 5/1939 | Hyde | 446/353 |
| 2,733,545 | 2/1956 | Guadagna | 446/330 |
| 3,153,871 | 10/1964 | Semba | 446/353 |
| 3,566,537 | 3/1971 | Tepper et al. | 446/354 |
| 3,882,735 | 5/1975 | Shimodaira et al. | 74/435 |
| 4,389,811 | 6/1983 | Iwaya et al. | 446/322 |

FOREIGN PATENT DOCUMENTS

| | | | |
|---|---|---|---|
| 2089225 | 6/1982 | United Kingdom | 446/353 |

*Primary Examiner*—Robert A. Hafer
*Assistant Examiner*—Daniel Nolan
*Attorney, Agent, or Firm*—James E. Nilles

[57] ABSTRACT

A toy with a swing wherein on a perch member of a swing a monkey toy member is mounted. The perch member has a switching mechanism and cells therein. The monkey toy member has a driving mechanism electrically connected to the cells, a swinging mechanism connected in association to the driving mechanism for swinging the monkey toy member forwards and backwards, a tail moving mechanism connected in association to the driving mechanism for curling and extending a tail of the monkey toy member, and a squeaking mechanism associated intermittently with the swinging mechanism for opening and closing a mouth of the monkey toy member to squeak. The monkey toy member is supported movably in the forward and backward direction on a base shaft secured transversely to the perch member.

1 Claim, 7 Drawing Figures

TOY WITH SWING

BACKGROUND OF THE INVENTION

1. Field of the Invention

The present invention relates to a toy with a swing, and more particularly to a toy with an appearance that a toy member simulating a monkey is sitting on a swing.

2. Description of the Prior Art

Various kinds of monkey toys have been proposed in which the toy member is merely imitative of the figure to a monkey or of the action of a monkey. The monkey toys up to now have generally been designed to act and move on the floor or to be played with by a child.

SUMMARY OF THE INVENTION

The present invention is designed to provide a monkey toy in which a toy member imitative of a monkey enjoys swinging while performing a certain series of actions on the swing, thereby maintaining the playfulness of the toy member, and further suitable to serve as a room accessary giving an interesting charm to the persons in the room.

The monkey top of the present invention is characterized by including a swing comprising a suspension member and a perch member supported by the suspension member, which has a switching mechanism and houses battery cells therein, a monkey toy member mounted on the perch member of the swing and housing a driving mechanism electrically connected to the cells, a swinging mechanism connected in association to the driving mechanism of the monkey toy member for swinging the monkey toy member forwards and backwards, a tail moving mechanism connected in association to the driving mechanism of the monkey top member for curling and extending the tail of the monkey toy member, and a squeaking mechanism associated intermittently with the swinging mechanism for opening and closing the mouth of the monkey toy member to squeak.

Other objects and advantages of the present invention will be apparent in conjunction with a description of a preferred embodiment with reference to the accompanying drawings.

DESCRIPTION OF THE PREFERRED EMBODIMENT

Figure 1:
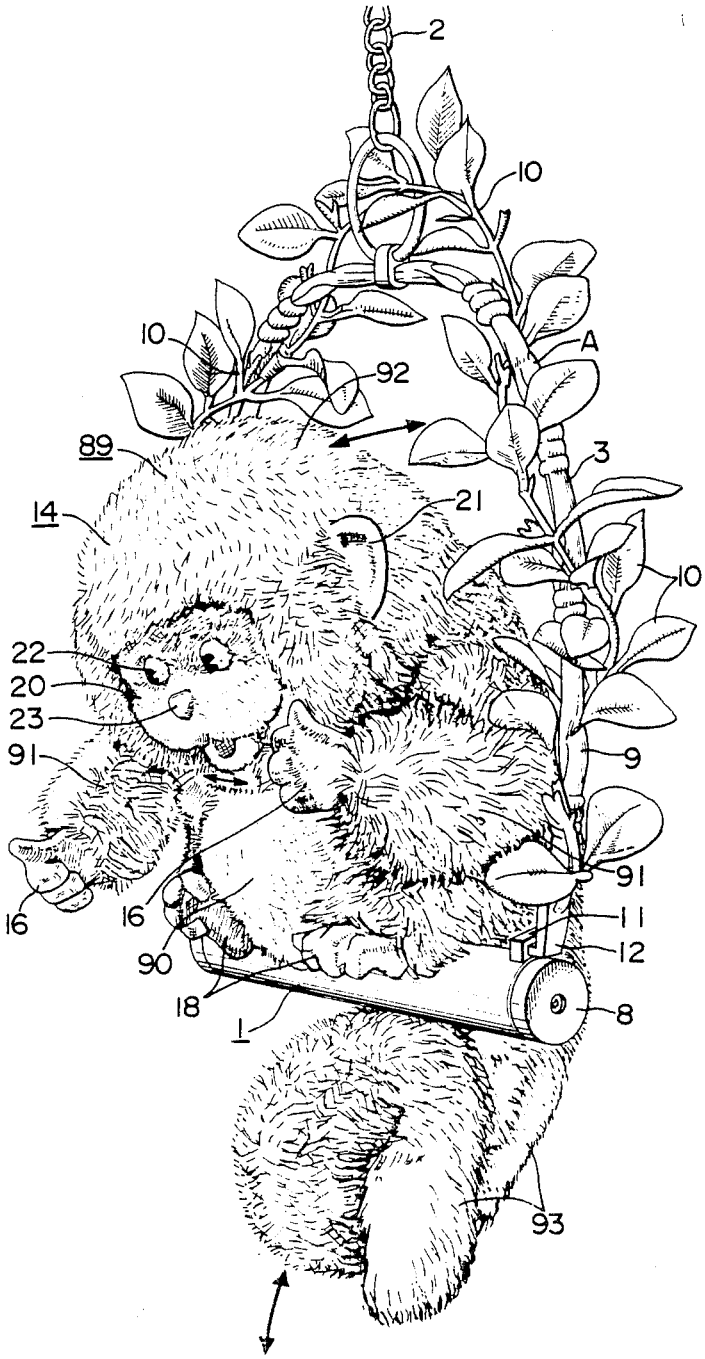
FIG. 1 is a perspective view of a toy with a swing of the present invention.
Figure 2:
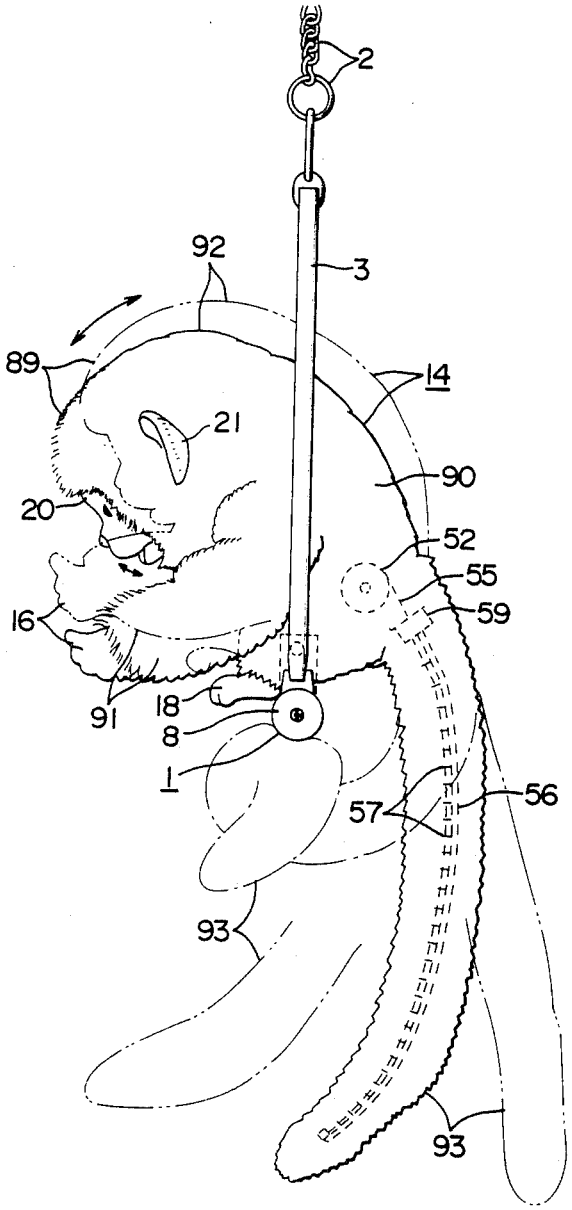
FIG. 2 is an explanatory view of the operation of the toy shown in FIG. 1.
Figure 3:
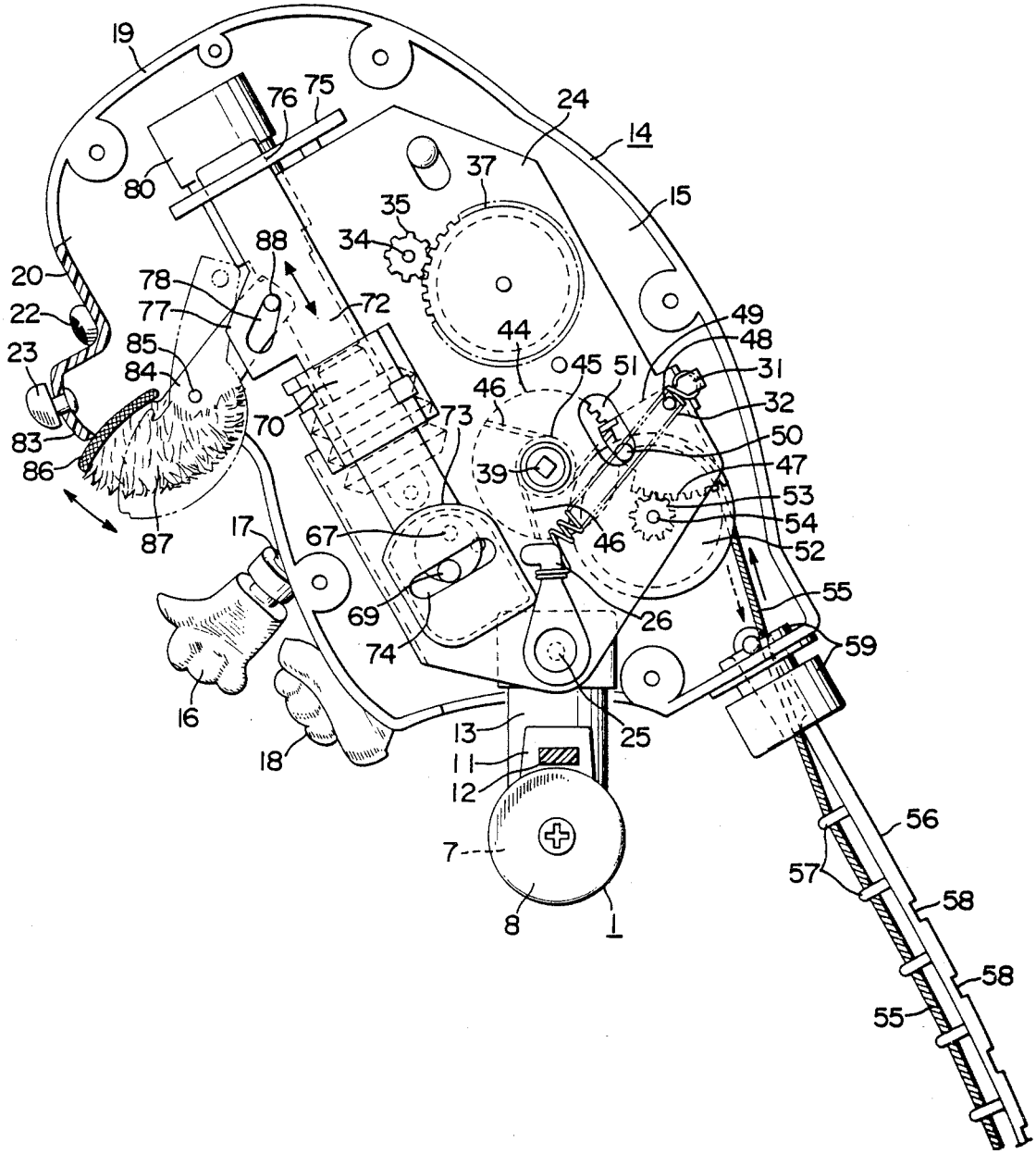
FIG. 3 is a view on one side showing the interior mechanisms of the toy.
Figure 4:
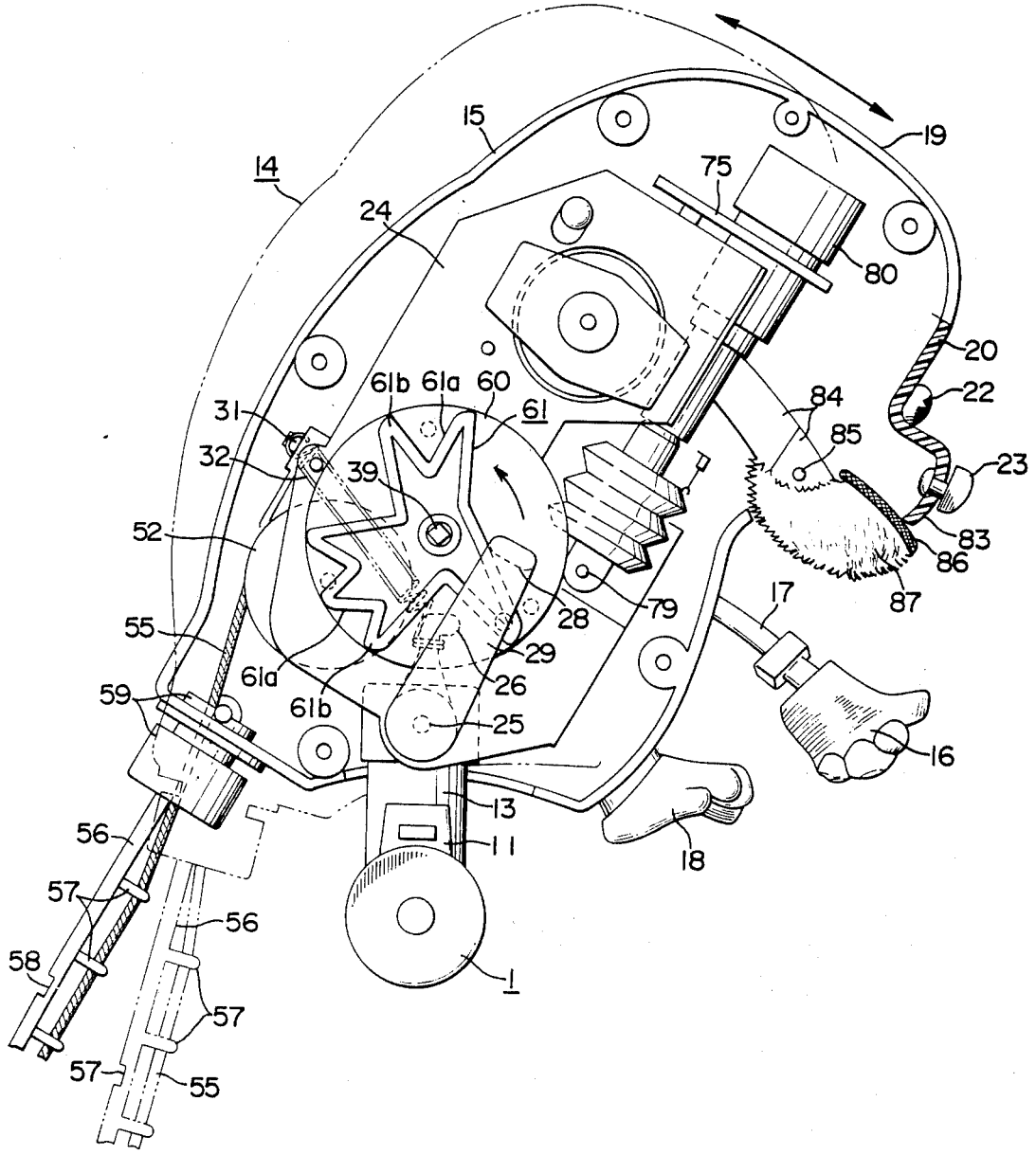
FIG. 4 is a view on the other side similar to FIG. 3.
Figure 5:
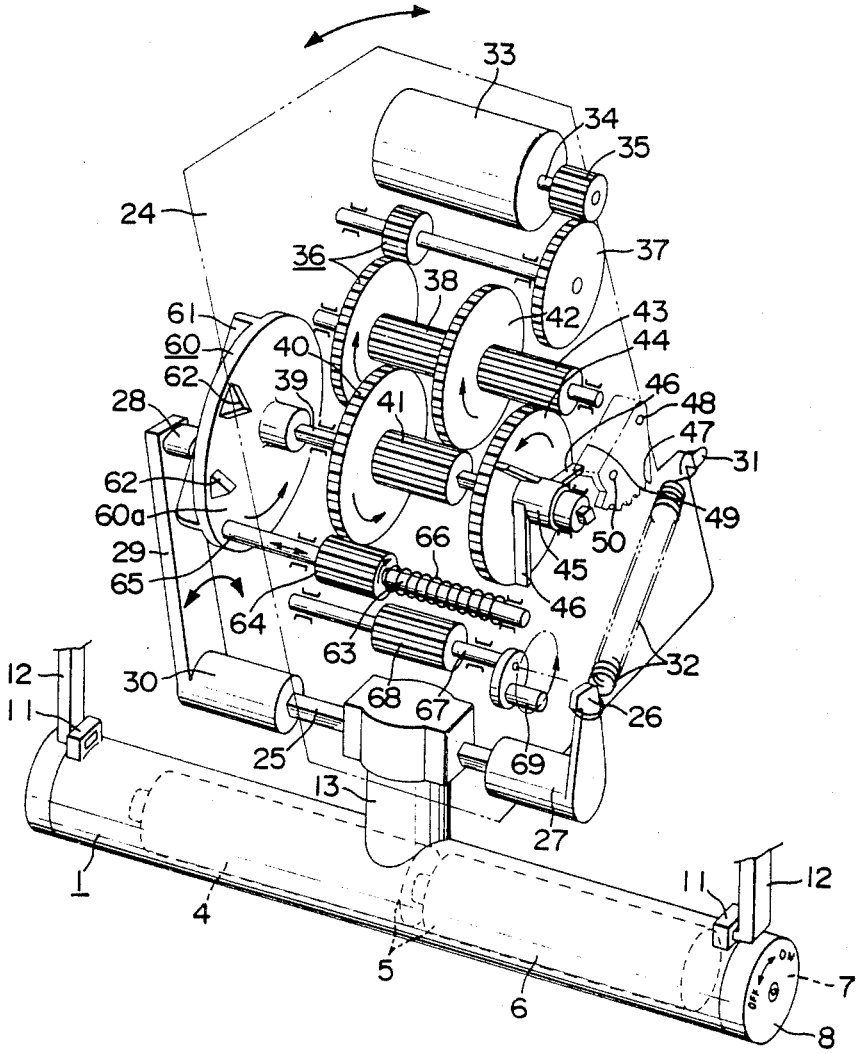
FIG. 5 is a perspective view of a mechanism for coordinating all the actions of the toy.
Figure 7:
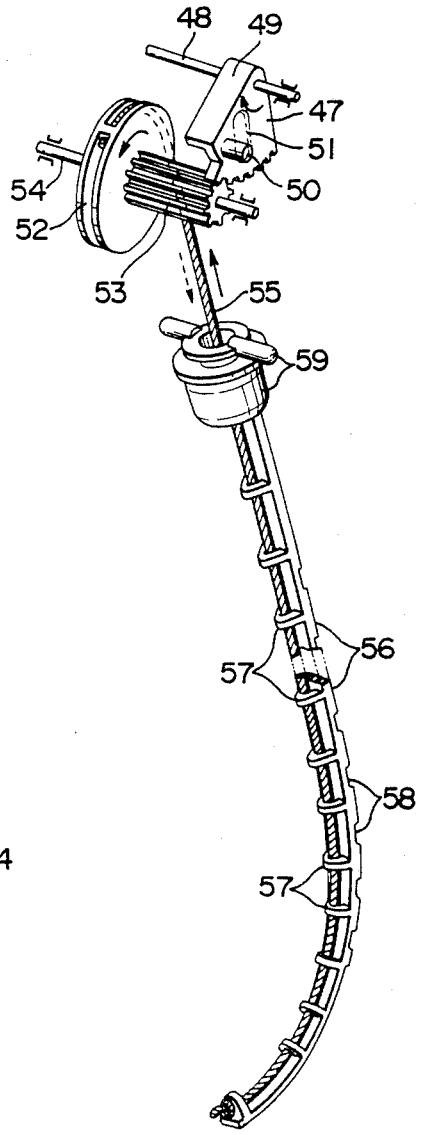
FIG. 7 is a perspective view of the tail moving mechanism of the toy.
Figure 6:
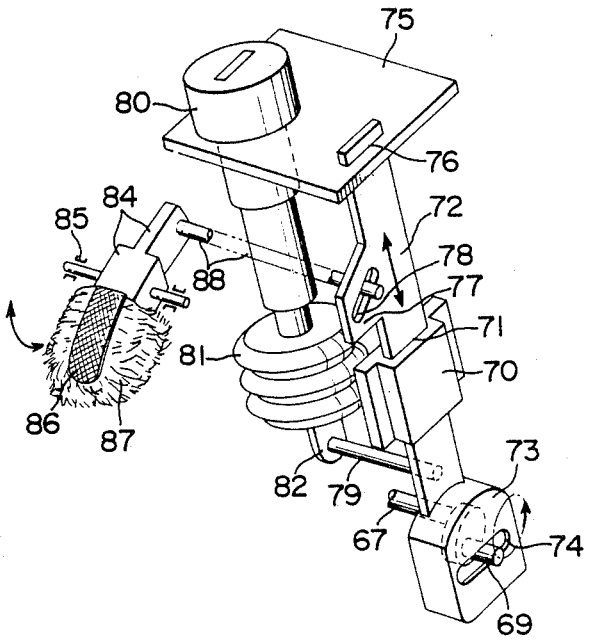
FIG. 6 is a perspective view of the squeaking mechanism of the toy.

In the drawings, reference A denotes a swing, which is constituted by a perch member 1 and a suspension member 3 having a suspension chain 2 as a suspending means at the upper end. The perch member 1 is formed of a synthetic resin, as a hollow cylinder with one end closed. The hollow part 4 of the perch member 1 is formed as a case 6 for housing battery cells 5. At an opening on the end opposite the closed end of the cell housing case 6, a cover memnber 8 with a switching mechanism 7 is fitted detachably and rotatably for turning ON and OFF of the switch.

The suspension member 3 is formed of synthetic resin in an inverted U-shape. The suspension member 3 is made to look like a vine having a stem 9 and an ivy 10 of synthetic resin creeping around the stem 9. At each lower end of the member 3, a hook 12 is formed for engaging disengageably with an eye member 11 on each end of the perch member 1.

In the middle part of the perch member 1, a hollow cylindrical supporter 13 is planted integrally, on which a monkey top member 14 initiative of a monkey is sitting. The monkey toy member 14 is adapted to make various kinds of actions.

The monkey top member 14 has a body frame 15 formed in the shape of the monkey body and arm frames 17 projecting from both sides of the body frame 15 and having hand members 16 of synthetic resin. Through the arm frame 17, a bendable core member of wire shape (not shown) is inserted, by which the arm frame 17 is bent and stretched. To the lower parts on both sides of the body frame 15, leg members 18 of synthetic resin are attached, which are arranged on the perch member 1. In a head frame 19 formed in continuation with the upper end of the body frame 15, a face member 20 and two ear members 21 are formed, and on the face member 20, two eyes 22 and a nose 23 are mounted.

Within the body frame 15, a machine frame 24 is provided, the lower end of which is supported by a base shaft 25 extending transversely through the supporter 13 in such a manner that it can rotate in the forward and backward direction. The base shaft 25 has a spacer 27 secured at one end, which has an engaging projection 26, and another spacer 30 secured at the other end, which has a projection 29 with an engaging piece 28 at the upper end as a swinging mechanism. Between a rising piece 31 in the rearward part on one side of the machine frame 24 and the engaging projecting 26, a coil spring 32 is stretched, by which the machine frame 24 is biased toward the engaging piece 28.

In the upper part of the machine frame 24, an electric motor 33 is mounted to serve as a driving mechanism which is electrically connected to the cells 5 in the cell housing 6. With a pinion 35 fixed to an output shaft 34 of the motor 33, an input gear 37 of a gear associating mechanism 36 is engaged. Further, with a first output gear 38 of the gear associating mechanism 36, a driving gear 40 fixed to a driving shaft 39 is engaged, and with an association gear 41 formed integrally with the driving gear 40, a relay gear 42 of the gear associating mechanism 36 is engaged. With a second output gear 43 formed integrally with the relay gear 42 is engaged an operation gear 44 as a part of a tail operating mechanism fixed to the driving shaft 39. From a boss 45 projecting on the outer side of the operation gear 44, a plurality of operation pieces 46 extend radially along the outer surface of the operation gear 44. In the rearward and lower part of the machine frame 24, a sector gear 47 as another part of the tail operating mechanism is supported rotatably through a support shaft 48. On one side edge of the sector gear 47, an engaging piece 49 is formed in the horizontal direction to engage with the respective operation pieces 46 of the operation gear 44. In addition, an engaging projection 50 protruding on the side edge of the sector gear 47 projects movably within an engaging slit 51 formed as elongated in the vertical direction in the machine frame 24. With the sector gear 47 is engaged an association gear 53 of a winding wheel 52 that is a further part of the tail operating mechanism. The winding wheel 52 and association gear 53 are secured rotatably to the machine frame 24 through a transverse shaft 54. A cord 55 as a still further part of the tail operating mechanism secured at one end to the winding wheel 52, is secured at its other end to the tip end of a tail frame 56 of synthetic resin. The tail frame 56 is shaped as a narrow flat plate and provided with a number of guide eyes 57 formed at intervals on one surface, through which the cord 55 is inserted slidably. On the other surface of the tail frame 56, a number of thin recesses 58 are positioned between the respective guide eyes 57 to provide flexibility to the frame 56. Further, in the base end, an engaging part 59 for engaging with the lower part of the machine frame 24 is formed. When the winding wheel 52 rotates in the winding direction, the cord 55 is wound so that the tail frame 56 is lifted up from its tip end to be rolled.

One end of the driving shaft 39 projects out of the machine frame 24 and a cam disc 60 as a swinging mechanism is secured fixedly to this projecting end. On the outer surface of the cam disc 60, a cam 61 is formed integrally, which is substantially formed in a star shape comprising a plurality of concaves 61*a* and convexes 61*b* of various sizes arranged continuously and irregularly. The cam 61 is normally biased by the coil spring 32 so as to engage with the engaging piece 28 of the projection 29. On the periphery of the inner surface of the cam disc 60, a plurality of pushing projections 62 are formed integrally at intervals around it.

A slider shaft 63 is mounted slidably and transversely on the machine frame 24. To the middle of the slider shaft 63 is secured a long switch gear 64 engaged with the driving gear 40. To one end of the slider shaft 63 is integrally secured a synthetic-resinous pressure receiving member 65, which is in a sliding contact with the inner surface 60*a* and pushing projections 62 of the cam disc 60. Between the switch gear 64 and machine farme 24, a coil spring 66 is wound around the slider shaft 63, which biases the pressure receiving member 65 so that it normally engages with the inner surface 60*a* of the cam disc 60.

Further, on the machine frame 24, a crank shaft 67 as one component of a squeaking mechanism is mounted transversely and rotatably. To the crank shaft 67 is integrally secured a long association gear 68 engageable with the switch gear 64. A crank arm 69 provided at one end of the crank shaft 67 protrudes outside the machine frame 24.

In the middle on one side of the machine frame 24, a synthetic-resinous guide frame 70 is secured, which has a guide hole 71 opened in the vertical direction, therough which an ascendable piece 72 of synthetic resin as another component of the squeaking mechanism is inserted movably in the vertical direction. In a cover part 73 for covering a bent part of the crank shaft 67 formed at the lower end of the ascendable piece 72 there is a horizontally elongated guide groove 74, in which the crank arm 69 is rotatably engaged. The upper end of the ascendable piece 72 is inserted and supported slidably within a guide groove 76 of a mounting plate 75 fixed to the machine frame 24. The ascendable piece 72 has on its upper portion a lateral projection 77 with a sloped elongated groove 78 has at its bottom a horizontally projecting and stop rod 79. On the mounting plate 75, a squeaker 80 as a further component of the squeaking mechanism is mounted. Through a mounting piece 82 projecting from the lower end of a bellows part 81 of the squeaker 80, the tip end of the stop rod 79 of the ascendable piece 72 is inserted and stopped.

Further, at a position corresponding to an upper jaw part 83 of the face member 20 in the head member frame 19, a lower jaw frame 84 as a still further component of the squeaking mechanism is mounted a pivot shaft 85 to be swingable in the vertical direction. On the upper surface of the lower jaw frame 84, a tongue piece 86 is secured, and on the lower surface thereof, a napping member 87 imitative the napping of the monkey is secured. An association rod 88 projected horizontally into the rearward part of the lower jaw frame 84 is inserted into the sloped elongated groove 78 of the ascendable piece 72.

The body member frame 15, arm frames 17 on both sides, head member frame 19 and tail frame 56, respectively combined with a napping cover member 89 imitative of the napping of the monkey, constitute a body member 90, arm members 91 on both sides, head member 92 and tail member 93 respectively.

The description will now proceed to the operation of the toy as constructed as mentioned above.

At first, the suspension chain 2 is hung by a supported member at a desired position, for example, by hanging. By this, such an appearance is obtained that a monkey toy member 14 is enjoying swinging on the perch member 1.

In this instance, the arm members 91 on both sides, formed flexibly by the arm frame 17 of synthetic resin and a bendable core member, can easily show various forms of action of the monkey selected as desired.

Then, if the cover member 8 of the cell housing case 6 in the perch member 1 is turned, the switching mechanism 7 is turned ON to start the motor 33. Upon starting of the motor 33, the input gear 37 of the gear associating mechanism 36, the first output gear 38 of the gear associating mechanism 36 and the driving gear 40, which gears are engaged in this order with the pinion 35 of the motor 33, are started to rotate in association. By this rotation of the driving gear 40, the driving shaft 39 is rotated, and also the relay gear 42 engaged with the association gear 41 of the driving gear 40, and further the operation gear 44 engaged with the second output gear 43 of the relay gear 42 are rotated in association.

By the rotation of the driving shaft 39, the cam disc 60 secured to one end of the driving shaft 39 is rotated, causing the cam 61 formed on its outer surface to rotatably slide along the engaging piece 28 of the projection 29 on the base shaft 25 through the supporter 13. In this instance, as the cam 61 is formed by a plurality of irregular concaves 61*a* and convexes 61*b* of different size, the machine frame 24 swings forward and backward around the base shaft 25 against the coil spring 32, whenever the engaging piece 28 engages with and disengages from the concaves and convexes 61*a* and 61*b*. Accordingly, the monkey toy member 14 shows repeatedly a movement similar to the swinging of the body in the forward and backward direction.

Also, by the rotation of the operation gear 44, the respective operation pieces 46 projecting radially on the outer surface of the gear 44 engage with the engaging piece 49 of the sector gear 47 successively, so that the sector gear 47 is rotated intermittently around the support shaft 48. In more detail, as the respective operation pieces 46 are rotated, one of the operation pieces 46 falls into engagement with the engaging piece 49 and thereafter rotates together with the engaging piece 49, and the sector gear 47 provided with the engaging piece 49 therefore rotates corresponding around the support shaft 48.

When the sector gear 47 is rotated, the winding wheel 52 is rotated through the association gear 53 engaged with the sector gear 47, so that the cord 55 secured at one end to the winding wheel 52 is wound around the wheel 52, and further the tail frame 56, secured at its tip end to the other end of the cord 55, is rolled gradually from its tip end. Therefore, the monkey toy member 14 shows a movement to roll up the tail member 93, while showing a movement to swing its body in the forward and backward direction.

When the operation piece 46 further rotates to disengage from the engaging piece 49 of the sector gear 47, the return rotation of the sector gear 47 due to its own weight and the force of restoration of the rolled tail frame 56 causes the winding wheel 52 to rotate in the unwinding direction, so that the wound cord 55 is unwound so as to extend the tail frame 56 instantly. Accordingly, the monkey toy member 14 shows a movement to extend the rolled tail member 93 downward.

Thus, accompanying the engagement and disengagement occurring successively and intermittently between the respective operation pieces 46 and engaging piece 49, the second gear 47 rotates forwards and backwards around the support shaft 48 and the tail member 93 is curled and then extended down repeatedly.

Accordingly, the monkey toy member 14 repeatedly shows a movement to swing its body forwards and backwards on the swing, and meanwhile repeatedly shows an intermittent movement to curl and extend the tail member 93.

In a transient state from the tail member 93 curled-up state to the hanging-down state, as the moneky toy member 14 is showing a body swinging movement continuously and intermittently, the tail member 93, reacting to the forward and backward movement of the monkey body, shows a swinging movement backwards and forwards in the stretched-down state.

Next, in this case, the slider shaft 63 is rotated by the switch gear 64 engaged with the driving gear 40, and the pressure receiving member 65 rotates in sliding contact with the inner surface 60*a* of the cam disc 60. By the rotation of the cam disc 60, a pushing projection 62 comes into engagement with the pressure receiving member 65, which is pushed thereby in the axial direction. Thus the slider shaft 63 is moved in the axial direction against the force of the coil spring 66, so that the switch gear 64 of the slider shaft 63, kept in engagement with the driving gear 40, comes into engagement with the association gear 68, so that the association gear 68 is rotated by the switch gear 64. By the rotation of the association gear 68, the crank shaft 67 is rotated and the crank arm is also rotated. Further, the ascendable piece 72 connected to the crank arm 69 through the elongated guide groove 74 ascends and descends while guided by the guide frame 70. By this ascending and descending movement of the ascendable piece 72, the stop rod 79 of the piece 72 pushes to contract the bellows part 81 of the squeaker 80, thereby activating the squeaker 80. The association rod 88 inserted through the sloped elongated groove of the ascendable piece 72 is made to move in the vertical direction by the ascending and descending movement of the piece 72. Therefore, the lower jaw frame 84 having the association rod 88 is swung up and down with respect to the upper jaw part 83 around the support shaft 85, to show a movement to open and close the mouth of the monkey toy member 14. Accordingly, if the crank shaft 67 is being rotated by the switch gear 64 through the association gear 68, the monkey toy member 14 shows a movement to open and close its mouth while squeaking.

When the pushing projection 62 comes out of engagement with the pressure receiving member 65, the slider shaft 63 is made to slide and return by the restoring force of the coil spring 66, so that the switch gear 64 disengages from the association gear 68 and also the pressure receiving member 65 comes again into a sliding contact with the inner surface of the cam disc 60. As a result of this, the crank shaft 67 is prevented from rotation, therefore the monkey toy member 14 stops moving the mouth and squeaking. Thus, in proportion to the number of pushing projections 62 and the interval between the projections 62, the monkey toy member 14 repeats the squeaking operation alternately and intermittently.

In the ON state of the switching mechanism 7, the monkey toy member 14 performs the various actions repeatedly and continuously.

According to the present invention, as the monkey toy member is mounted on the perch member of the swing, if the swing is hung at a desired high position, the monkey toy member shows an appearance in which the monkey is enjoying swinging. Further, by operating the switching mechanism of the monkey toy member to drive the driving mechanism, the swinging mechanism, tail operating mechanism and squeaking mechanism are mutually associated move, thereby showing a movement to of the swing (forwards and backwards) by the monkey toy member while it is sitting on the perch member. Also, by the operation of the tail operating mechanism, the tail member is bent and curled and extended down, thereby showing a movement to give reaction to the swinging action. Similarly, by the intermitting operation of the squeaking mechanism, a pleasant movement to open and close the mouth and to squeak is shown. These various kinds of action are repeated continuously to constitute a series of monkey actions. Thus, the monkey toy member shows an appearance of riding on the swing and enjoying the swinging while performing several interesting motions. Accordingly, if this monkey toy is hung at a desired position in the room, a very interesting moving accessory can be provided.

What is claimed is:

1. A toy that simulates a monkey swinging on a swing, comprising a suspension member, a perch member which is supported by said suspension member and which houses at least one battery cell, a toy monkey member having a tail which normally extends downward and which has an upper end and a lower tip end, said toy monkey member being mounted on said perch member and housing a driving mechanism electrically connectable to said cell and a swinging mechanism which is driven by said driving mechanism and whereby the perch member and the toy monkey member are caused to move alternately forward and backward, said toy being characterized by means for causing said tail to alternately curl up and extend when said driving mechanism is operating, comprising: an elongated tail frame within said tail that is resiliently flexible lengthwise, said tail frame having guide eyes at one lateral side thereof spaced at intervals along its length; a cord extending through said guide eyes and having one end secured to the tip end of the tail frame so that taking up the other end of the cord causes the tail frame to curl; a winding wheel adjacent to the upper end of the tail frame and to which said other end of the cord is eccentrically connected, said winding wheel being rotatable in a winding direction to take up the cord and being rotatable in the opposite direction by unwinding of the cord under uncurling bias of the tail frame; a driven gear concentric with said winding wheel and constrained to rotate therewith; a sector gear swingable about a sector gear axis and having gear teeth concentric to that axis which mesh with the teeth of the driven gear so that swinging of the sector gear in one direction imparts rotation in said winding direction to the winding wheel and rotation of the winding wheel in said opposite direction swings the sector gear in its opposite direction, said sector gear also having a cam follower surface extending substantially radially in relation to said axis; and a cam disc driven by said driving mechanism for unidirectional rotation about a cam disc axis which is in fixed spaced relation to said sector gear axis, said cam disc having thereon at least one substantially radially extending camming surface which engages said cam follower surface during one part of each revolution of the cam disc to swing said sector gear in said one direction, said cam disc being disengaged from said second gear during another part of the cam disc revolution to permit the winding wheel and the sector gear to move in their said opposite directions.

* * * * *